US006471033B2

(12) United States Patent
Ulrich

(10) Patent No.: US 6,471,033 B2
(45) Date of Patent: Oct. 29, 2002

(54) LUBRICATING DEVICE FOR AN ESCALATOR OR A MOVING WALKWAY

(75) Inventor: Robert Ulrich, Bruckneudorf (AT)

(73) Assignee: Inventio AG, Hergiswil NW (CH)

( * ) Notice: Subject to any disclaimer, the term of this patent is extended or adjusted under 35 U.S.C. 154(b) by 61 days.

(21) Appl. No.: 09/817,845

(22) Filed: Mar. 26, 2001

(65) Prior Publication Data

US 2001/0023811 A1 Sep. 27, 2001

(30) Foreign Application Priority Data

Mar. 27, 2000 (EP) ..... 00810260

(51) Int. Cl.[7] ..... B66B 21/00

(52) U.S. Cl. ..... 198/321; 198/500

(58) Field of Search ..... 198/321, 333, 198/500; 194/5, 12

(56) References Cited

PUBLICATIONS

Patent Abstracts of Japan, "Escalator With Sliding Agent Coating Function" Pub. No. 8225285 Sep. 3, 1996 (with attached patent copy).
Patent Abstracts of Japan, "Lubricant Coating Device For Escalator", Pub. No. 10109874, Apr. 28, 1998.
ESP@CENET Database "Guide Rail Oil Feeding Device For Passenger Conveyor", JP 5319767, pub. Mar. 12, 1993.

*Primary Examiner*—Joseph E. Valenza
(74) *Attorney, Agent, or Firm*—Schweitzer Cornman Gross & Bondell LLP

(57) ABSTRACT

A lubricating device for an escalator or moving walkway provides a lubricant container connected by way of lines with lubrication points which are arranged at a base plate which forms lateral borders for the escalator/moving walkway step belt or plate belt. Sliding pads are provided at the escalator steps of the step belt or at the plates of the plate belt which project slightly beyond the side edges of the steps or plates and, when sliding past the lubrication points, receive lubricant and subsequently transfer it to the base plate.

9 Claims, 4 Drawing Sheets

LUBRICATING DEVICE FOR AN ESCALATOR OR A MOVING WALKWAY

The present invention relates to a lubricating device for an escalator or a moving walkway, wherein a step belt of the escalator or a plate belt of the moving walkway is guided between lateral borders and wherein lubricant containers connected with fixed lubrication points by way of lines are provided.

BACKGROUND OF THE INVENTION

Lubricating devices of the identified general type have the purpose of preventing the increase of friction and the development of noise between escalator/moving walkway base plates and the moving step belt or plate belt as a result of environmental contaminating deposits, which are virtually unavoidable, and which may include dust, abrasives from subway brakes, etc., which collect at base plates of the escalator or moving walkway, as well as deposits from material deterioration.

Japanese patent specification JP 531 9767 discloses a lubricating device for escalators by means of which guide rails for the step belt of the escalator can be lubricated. For this purpose there is provided a solenoid valve which is supplied with power by a battery and which is arranged at an outlet opening of an oil container fastened to an escalator step. A pipe, through which a guide rail for the rear wheel of the escalator step is lubricated, is connected to the valve. A flexible hose, through which the lubricant is led to a guide rail for the front wheel of the escalator step, branches from the pipe. A timer is provided for control of the valve. Fault-free lubrication at the sides of the escalator is not guaranteed. In addition, the escalator step concerned has to be demounted for maintenance operations.

Japanese patent specification JP 08225285 discloses another lubricating device for an escalator in which lubricating agent holders are provided at the side edges of the rear side of the tread and riser of an escalator step. Bristles, which form brushes and which contact the side walls of the escalator, protrude out of the lubricating agent holders. A lubricating agent container fastened to the rear side of the tread is connected to the lubricating agent holders and brushes by way of pipes and wicks inserted in the pipes. The escalator step also has to be demounted for maintenance operations with this lubricating device. Moreover, a relatively large amount of lubricating agent is consumed by the long brushes formed by the bristles; a wide lubricating track, which is only partly covered by the step belt, is formed.

BRIEF DESCRIPTION OF THE INVENTION

It is an object of the present invention to provide a lubricating device of the general kind set forth in which a lubricant container is readily accessible, such that the escalator step does not have to be demounted for maintenance and which generates a precise, covered, narrow lubricant track, conserving the lubricant.

The foregoing and other objects are met by a lubricant device having a lubricant container which is connected by way of lines to lubrication points which are arranged at lateral borders of the step belt of the escalator or of the plate belt of the moving walkway. Sliding pads are provided at the escalator steps/moving walkway plates. The pads project slightly beyond the lateral edges of the steps or plates and, when sliding past the lubrication points, receive the lubricant and transfer it to the lateral borders.

As those skilled in the art will recognize that the objects, effects and execution of the present invention are essentially identical in application to both escalators and moving walkways, for the sake of simplicity its only application to escalators will be described hereinafter.

In a preferred embodiment the lubricant container is arranged within a balustrade base at the upper part of the escalator. Projecting into the lubricant container is a lubricating wick, the other end of which is fastened in the region of the sliding pad to a base plate forming the lateral border and projects through a bore in the base plate, whereby the lubrication point is formed

BRIEF DESCRIPTION OF THE DRAWINGS

The invention is more fully explained in the following disclosure of illustrative embodiments in conjunction with the annexed drawings, in which.

DETAILED DESCRIPTION OF THE DRAWINGS

Figure 1:
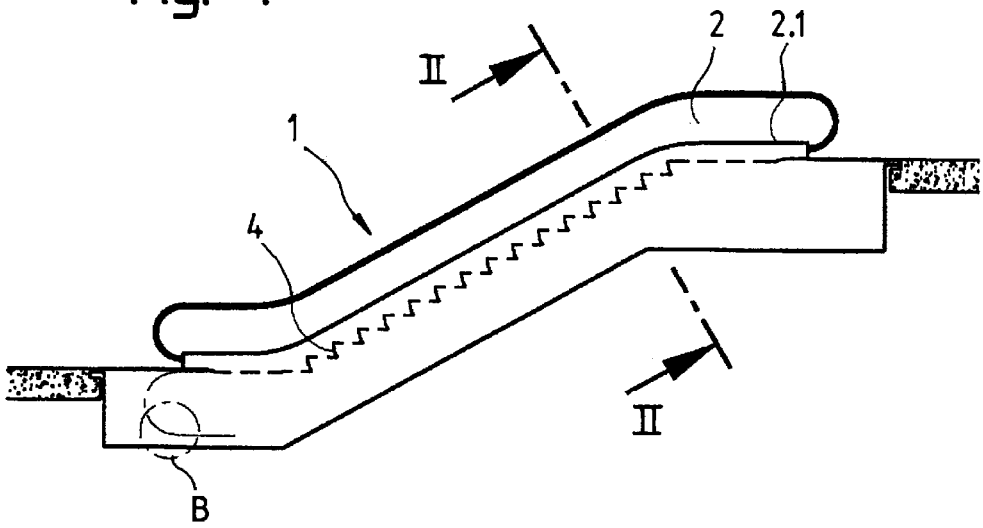
FIG. 1 is a simplified representation of a side view of an escalator incorporating the invention.
Figure 2:
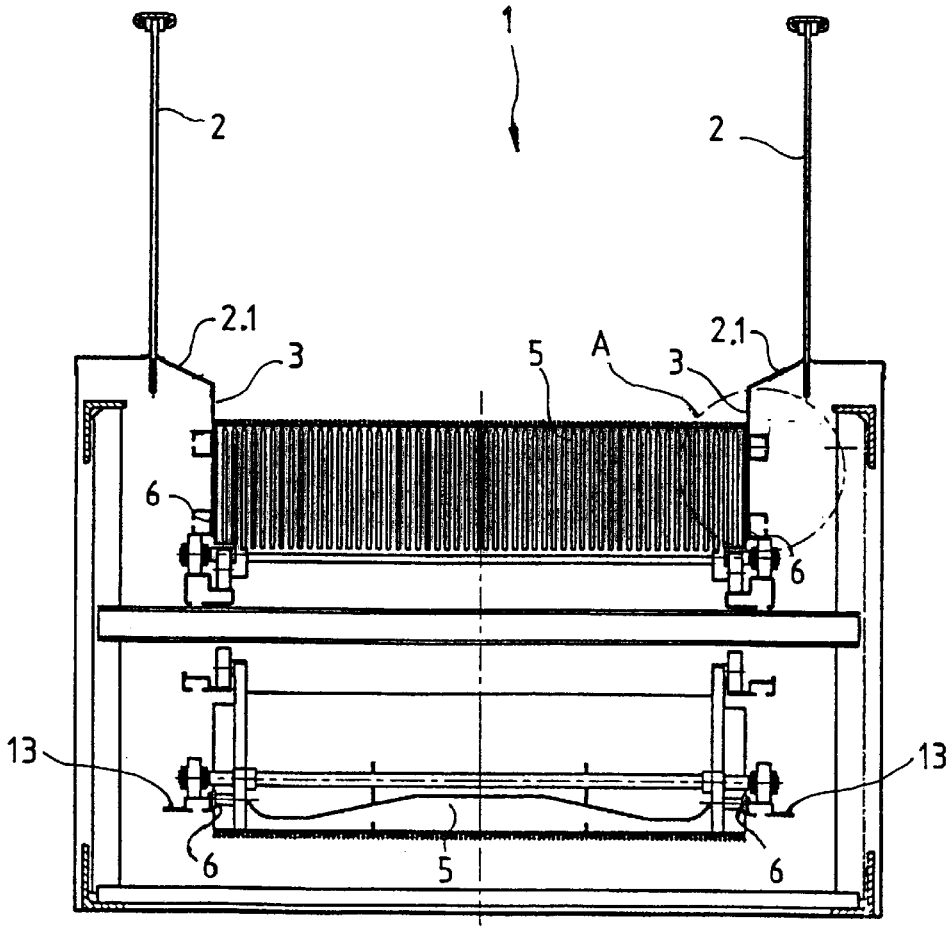
FIG. 2 is a cross-section elevation view taken along line 11—11 in FIG. 1.
Figure 3:
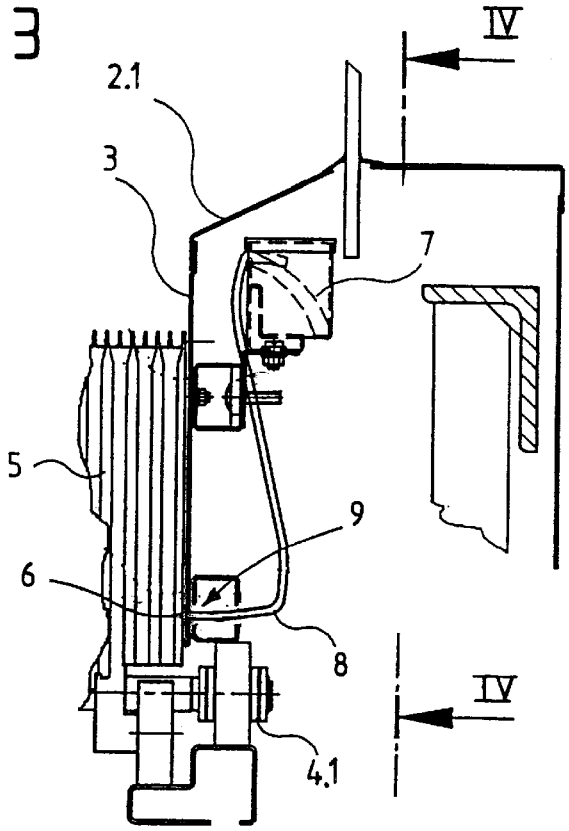
FIG. 3 is a view of detail "A" of FIG. 2 on an enlarged scale, detailing a first embodiment of the lubricating device according to the invention.
Figure 4:
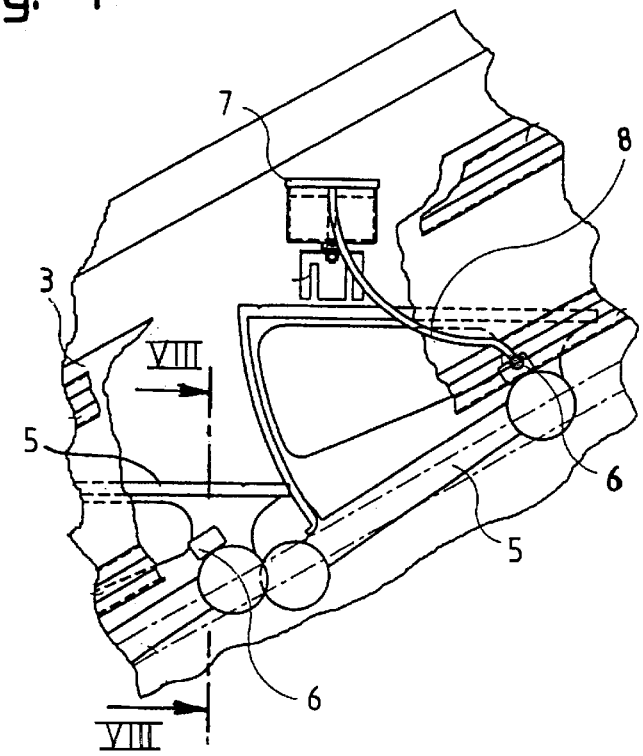
FIG. 4 is a partial section view taken along line IV—IV in FIG. 3.

With initial reference to FIGS. 1–4, escalator 1 has a step belt 4, which consists of escalator steps 5 connected together by means of a transport chain 4.1. The step belt is moved and guided in the upper part of the escalator 1 between base plates 3 forming lateral borders for the step belt. The base plates 3 are parts of opposed balustrade bases 2.1, to which a balustrade 2 is fastened. Located at the sides of the escalator steps 5 are sliding pads 6, which are more fully described in association with FIG. 8 and which project slightly (for example, 2 mm) beyond the side edges of the escalator steps 5 so that the step belt 4 is guided between the base plates 3 by means of the sliding pads 6. A lubricant container 7 is located in the upper part of the escalator 1 within the balustrade base 2.1. One end of a lubricating wick 8 extends into the lubricant container 7, while the other end of the lubricating wick 8 is fastened in the region of the sliding pads 6 to the base plate 3 and projects through a bore in the base plate 3, whereby a lubrication point 9 is formed. The lubricating wick 8 does not project so far out of the base plate 3 to be in contact with the edges of the escalator step 5, but extends such that it contacts the sliding pads 6. During travel operation of the escalator 1, the sliding pads 6 slide past the lubrication points 9, wherein they compress in the lubrication point 9 of the lubricating wick 8, receive lubricant and transfer it to the base plate 3. The wick can be supported, protected and surrounded by a shrink-fit hose.

Figure 5:
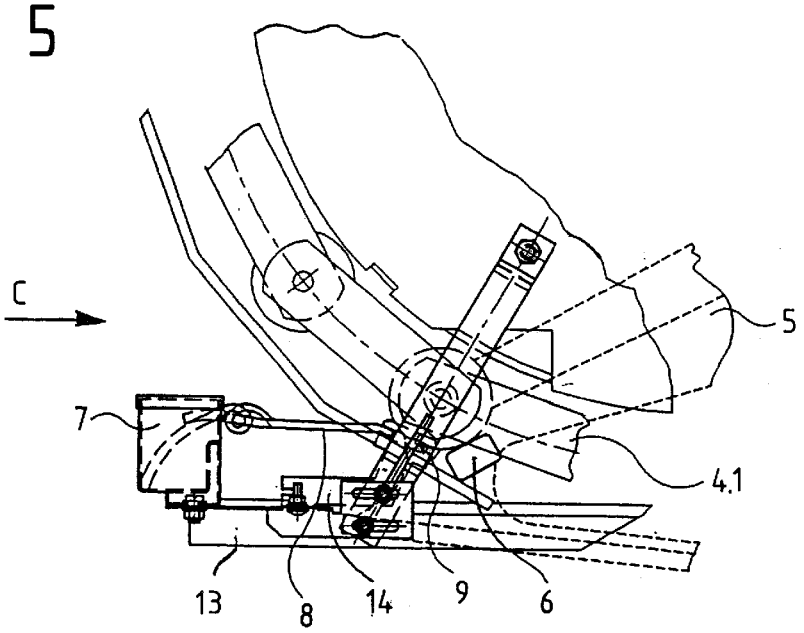
FIG. 5 is a view of detail "B" of FIG. 1 on an enlarged scale, detailing a second embodiment of the lubricating device.
Figure 6:
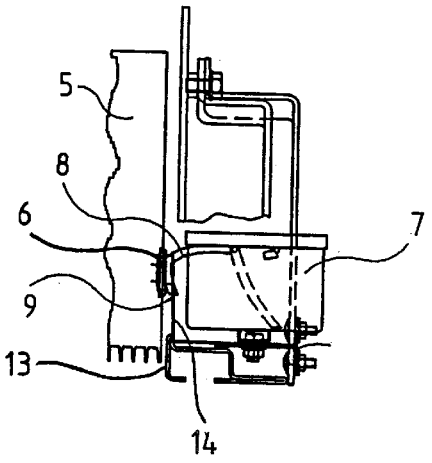
FIG. 6 is a view taken in the direction of arrow C of FIG. 5.

Referring to FIGS. 5 and 6, the lubricant container 7 is shown located in the lower region of the escalator 1 in the lower deflection of the step belt 4. One end of the lubricating wick 8 projects into the lubricant container 7, while the other end is fastened, in the region of the sliding pads 6 and a guide strip 13 for the step belt 4, to a wick holder 14, at which the lubrication point 9 is formed.

Figure 7:
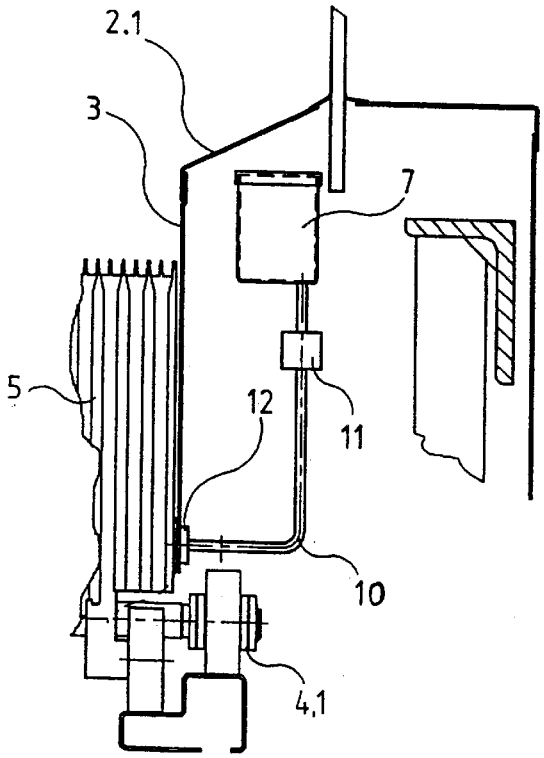
FIG. 7 is a view of detail "A" of FIG. 2 on an enlarged scale, depicting a third embodiment of the lubricating device.

In the embodiment according to FIG. 7 the lubricant container 7 is located above the lubrication point 9, and is connected with the lubrication point 9 by way of a lubricating line 10 in the form of a rigid pipe, so that gravity-fed lubrication is achieved. The lubrication point 9 is in this embodiment so designed that the lubricating line 10 is fastened in the region of the sliding pads 6 to the base plate 3 by means of an adapter member 12, which includes a part in the form of a felt element or brush having a bore for the delivery of the lubricant. A reducing valve 11 for regulation of the throughflow quantity of the lubricant may be arranged in the lubricating line 10. A flexible hose can also be used for the lubricating line 10 instead of the rigid pipe, wherein an adjustable hose clamp can be provided for throughflow regulation.

Figure 8:
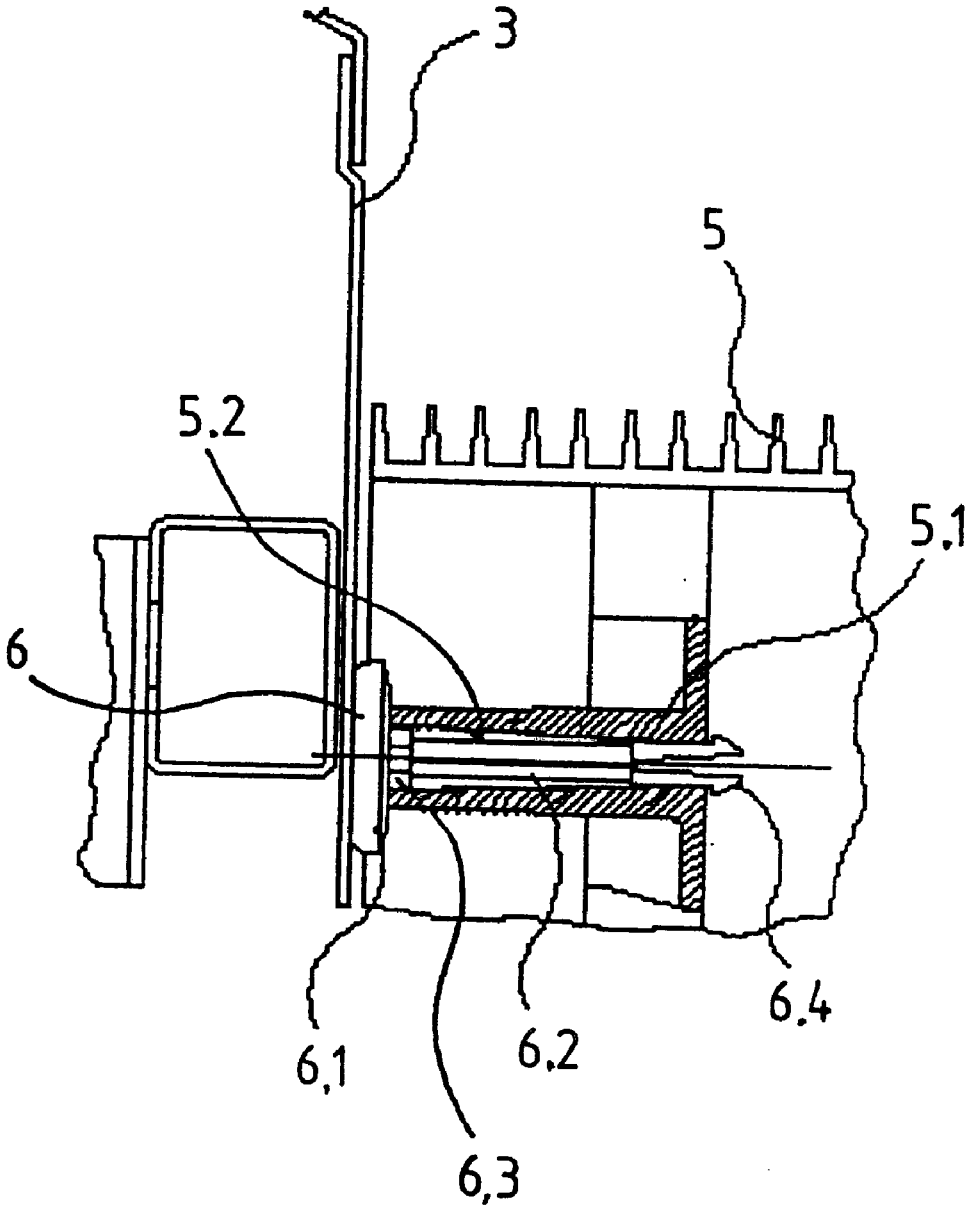
FIG. 8 is a partial section view, on an enlarged scale, taken along the line VIII—VIII in FIG. 4.

In the embodiment of the sliding pad shown in FIG. 8, a column 5.1 is fixedly connected to the escalator step 5 and has a throughbore 5.2 in which the sliding pad 6 is fastened. The sliding pad 6 may be of a wear-resistant thermoplastic synthetic material and comprises a flange-like guide part 6.1 and a shank 6.2, which is provided with rotatably securing support means 6.3, such as a collar, directly behind the guide part 6.1. The distal end 6.4 of the shank 6.2 is constructed in a known manner in such a way that the sliding pad 6 is retained in the bore 5.2, such as by a snap-fit.

As a further alternative to the embodiments of FIGS. 3 to 7, the lubricant container 7 can be connected by way of a conveying pump and metering elements in association with lubricating lines 10 to the lubrication points 9, which may be arranged at the base plates 3, preferably below the comb plates at the upper end of the escalator 1. Any excess lubricant can thus fall into the region of the return run for the step plates.

Lubrication can also take place through a central lubricating installation which supplies several other lubrication points of the escalator.

I claim:

1. A lubricating device for an escalator or moving walkway, wherein a step belt or a plate belt is guided between fixed lateral borders and wherein lubricant container means connected to lubrication points by way of lines are provided, characterized in that the lubrication points are located at the lateral borders and project outwardly therefrom and sliding pads are provided at the steps of the step belt or at plates of the plate belt and project slightly beyond the side edges of the escalator steps or the moving walkway plates to contact the lubrication points when passing thereby, receive lubricant from the lubrication points, and subsequently transfer the lubricant to the lateral borders.

2. A lubricating device according to claim 1, wherein the lateral borders in an upper part of the escalator or the moving walkway are formed by base plates, characterized in that the lubricant container means are arranged within a balustrade base in the upper part of the escalator or moving walkway and the lines comprise lubricating wicks, first ends of the lubricating wicks project into the lubricant container means, second ends of the lubricating wicks being fastened in a region of the sliding pads at the base plate and project through bores in the base plate, whereby the lubrication points are formed.

3. A lubricating device according to claim 1, wherein the lateral borders in a lower part of the escalator or the moving walkway are formed in the region of a lower deflection of the step belt or the plate belt or the plate belt by guide strips, characterized in that the lubricant container means is arranged in the lower part of the escalator or moving walkway in the region of the lower deflection of the step belt or plate belt and the lines comprise lubricating wicks, first ends of the lubricating wicks project into the lubricant container means, second ends of the lines being fastened to a wick container provided in a region of the guide strip, whereby the lubrication points are formed.

4. A lubricating device according to claim 2 or 3, characterized in the lubricating wicks are guided in shrink-fitted hoses.

5. A lubricating device according to claim 1, wherein the lateral borders in the upper part of the escalator or the moving walkway are formed by base plates, characterized in that the lubricant container means are arranged above a lubrication point and connected with the lubrication point by way of a lubricating line leading to the base plates, wherein the lubrication point comprises an adapter member at the base plate, in the region of the sliding pads and a felt element or a brush having a bore for delivery of the lubricant.

6. A lubricating device according to claim 5, characterized in that the lubricating line is a rigid pipe having a reducing valve for regulation of the throughflow quantity of the lubricant.

7. A lubricating device according to claim 5, characterized in that the lubricating line is a flexible hose having a hose clamp for regulation of the throughflow quantity.

8. A lubricating device according to claim 1, characterized in that the sliding pad consists of a flange-like guide part and a shank directly behind the guide part having rotational securing means and that a distal end of the shank has engagement means for retaining the sliding pad in a receiving bore in the escalator step or the moving walkway plate.

9. A lubricating device according to claim 8, characterized in that the sliding pad comprises a wear-resistant thermoplastic synthetic material.

* * * * *